US010391665B2

(12) United States Patent
Osborne

(10) Patent No.: US 10,391,665 B2
(45) Date of Patent: Aug. 27, 2019

(54) PRECISION DRYWALL PUNCH

(71) Applicant: Donovan David Osborne, Lithia Springs, GA (US)

(72) Inventor: Donovan David Osborne, Lithia Springs, GA (US)

( * ) Notice: Subject to any disclaimer, the term of this patent is extended or adjusted under 35 U.S.C. 154(b) by 0 days.

(21) Appl. No.: 15/825,970

(22) Filed: Nov. 29, 2017

(65) Prior Publication Data

US 2018/0154541 A1 Jun. 7, 2018

Related U.S. Application Data

(60) Provisional application No. 62/428,889, filed on Dec. 1, 2016.

(51) Int. Cl.

| | |
|---|---|
| ***B26F 1/32*** | (2006.01) |
| ***B26F 1/38*** | (2006.01) |
| ***B26F 1/44*** | (2006.01) |
| *E04F 21/00* | (2006.01) |

(52) U.S. Cl.

CPC ..... *B26F 1/3846* (2013.01); *B26F 1/32* (2013.01); *B26F 1/44* (2013.01); *B26F 2001/4472* (2013.01); *E04F 21/00* (2013.01)

(58) Field of Classification Search

CPC .. B26F 1/32; B26F 1/3846; B26F 1/44; B26F 2001/4472; E04F 21/00; B26B 3/08; B26B 5/005; Y10T 83/2133; Y10T 83/2159

See application file for complete search history.

(56) References Cited

U.S. PATENT DOCUMENTS 1,814,824 A * 7/1931 Cadenbach ..... C14B 5/00 83/128
2,791,134 A * 5/1957 Bien ..... B21D 37/205 76/107.8
3,170,358 A * 2/1965 Martin ..... B21D 37/205 76/107.8

(Continued)

FOREIGN PATENT DOCUMENTS

NL 9301691 A * 4/1995

*Primary Examiner* — Stephen Choi
(74) *Attorney, Agent, or Firm* — Alston & Bird LLP

(57) ABSTRACT

According to the present invention, an apparatus is provided that allows cutting an opening in a material, such as a wall or surface, while accurately controlling the depth of penetration so as not to damage or destroy any existing materials behind the wall or surface, and also without needing equal access behind the wall or surface. In a preferred embodiment of the invention, the apparatus includes a support block assembly having a thickness and at least one primary surface, the at least one primary surface defining a perimeter of the support block assembly; and one or more cutting blades coupled to the support block assembly in at least one location and extending away from the at least one primary surface, the one or more cutting blades being arranged in a closed plane orientation and each being coupled to the support block assembly such that the one or more cutting blades extend away from the at least one primary surface at an inset distance relative to the perimeter of the support block assembly. In another preferred embodiment, the apparatus includes one or more levels. And in another preferred embodiment, the apparatus includes a handle.

16 Claims, 9 Drawing Sheets

(56) References Cited

U.S. PATENT DOCUMENTS

| | | | | |
|---|---|---|---|---|
| 5,222,303 | A * | 6/1993 | Jardine | G01B 3/02 33/528 |
| 5,946,809 | A | 9/1999 | Bright | |
| 6,484,408 | B1 | 11/2002 | Dove | |
| 6,874,237 | B2 * | 4/2005 | Robitaille | B26F 1/22 30/315 |
| 7,454,844 | B1 * | 11/2008 | Ruby | B25H 7/02 30/358 |
| 8,230,712 | B2 | 7/2012 | Lee | |
| 8,555,515 | B2 | 10/2013 | Lien | |
| 8,844,144 | B2 | 9/2014 | Sannah | |
| 2004/0035015 | A1 * | 2/2004 | O'Connor | H02G 1/00 33/528 |
| 2006/0207108 | A1 * | 9/2006 | Lucero | B26B 3/04 30/315 |
| 2015/0335494 | A1 * | 11/2015 | Honda | A61F 15/02 156/251 |

* cited by examiner

PRECISION DRYWALL PUNCH

CROSS-REFERENCE TO RELATED APPLICATIONS

This patent application claims priority under 35 U.S.C. § 119(e) from Provisional Patent Application No. 62/428,889 filed Dec. 1, 2016, the disclosure of which is incorporated by reference herein in its entirety.

BACKGROUND OF THE INVENTION

This invention relates generally to the field of construction and building improvement, and more specifically to a new and useful precision drywall punch. During the construction of houses or buildings, or during modifications or improvements to houses or buildings, it is often necessary to cut openings in the wall material, such as drywall, in order to provide access to electrical wiring or low voltage wiring. If the home or building is not brand new construction, there typically exist materials, such as insulation, ducts, pipes, cables, gas lines, or wiring, already behind the walls. Therefore, when cutting openings in the wall material, care must be taken to avoid damaging or destroying what lies behind the wall. Such care is costly and time consuming, and if not done properly may consume more cost and time to repair or fix whatever damage is done.

Existing systems have focused on providing accurate measurement and penetration along the height and width of the opening to be cut in the wall material. For example, U.S. Pat. No. 7,454,844 discloses a rectangular cutting tool mounted on a graduated measuring stick that allows the tool to be accurately positioned to cut an opening exactly where along the height and width of the wall an opening is desired.

The problem with these systems is that there is no provision for the precise amount of depth of penetration desired. While they may provide accurate cutting along the height and width of the wall, there is nothing to limit how deep into the wall or past the actual wall material the cutting tool penetrates. Thus, there is still the potential to damage or destroy the materials, such as existing cables or wiring, behind the wall.

One solution to this problem is disclosed in U.S. Pat. No. 6,484,408. In that system, the tool has two cutting members, one for each side of the wall. The tool compresses the cutting members towards one another, cutting the wall which is sandwiched in between. The problem with such a system is that it requires both sides of the wall be easily accessible, such that one of the cutting members can be placed behind the wall. While that may be the case in new construction, that is not the case with an existing home or building that is, for example, undergoing renovations or remodeling.

Thus, there is a need for an improved precision drywall punch which can cut an opening in a wall or surface, while accurately controlling the depth of penetration so as not to damage or destroy existing materials behind the wall or surface, without needing equal access behind the wall or surface.

BRIEF SUMMARY OF THE INVENTION

The present invention solves the problem of cutting an opening in a wall or surface while accurately controlling the depth of penetration so as not to damage or destroy existing materials behind the wall or surface, and also without needing equal access behind the wall or surface. In a preferred embodiment of the invention, the apparatus includes a support block assembly having a thickness and at least one primary surface, the at least one primary surface defining a perimeter of the support block assembly; and one or more cutting blades coupled to the support block assembly in at least one location and extending away from the at least one primary surface, the one or more cutting blades being arranged in a closed plane orientation and each being coupled to the support block assembly such that the one or more cutting blades extend away from the at least one primary surface at an inset distance relative to the perimeter of the support block assembly.

In accordance with the invention, the support block assembly may be comprised of more than one component. Also in accordance with the invention, the cutting blades may be removable, and the position of the cutting blades may be adjusted to expose a different cutting blade length such that varying depths of penetration may be accurately achieved. Also in accordance with the invention, the cutting blades may be smooth, serrated, or saw-toothed.

In another preferred embodiment of the invention, the apparatus includes one or more levels, such as a horizontal level and a vertical level, which allows for precision and accuracy when cutting an opening in a wall or surface. In yet another preferred embodiment of the invention, the apparatus includes a handle, which allows for better grip and provides another striking surface when cutting an opening in a wall or surface.

It is an object of the present invention to save time, effort, and cost in making openings in wall or surface materials, and to do so with both precision and speed, and all without damaging any existing materials behind the wall or surface.

BRIEF DESCRIPTION OF THE FIGURE(S)

Having thus described the invention in general terms, reference will now be made to the accompanying figures, which are not necessarily drawn to scale, and wherein:

DETAILED DESCRIPTION OF THE INVENTION

The present invention now will be described more fully hereinafter with reference to the accompanying figures, in which some, but not all embodiments of the invention are shown. Indeed, the present invention may be embodied in many different forms and should not be construed as limited to the embodiments set forth herein; rather, these embodiments are provided so that this disclosure will satisfy applicable legal requirements. Like numbers refer to like elements throughout.

Figure 1:
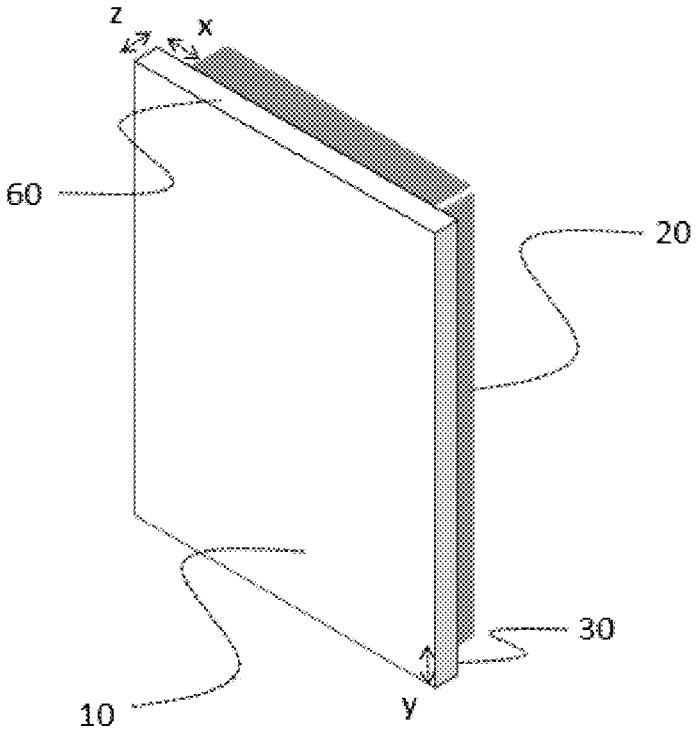
FIG. 1 shows an exemplary embodiment of the invention illustrating an apparatus that includes a support block assembly and cutting blades arranged in a rectangular orientation and positioned at an inset distance relative to the perimeter of the support block assembly.

As illustrated in FIG. 1, a preferred embodiment of the invention may include a support block assembly 10. The support block assembly may be made, for example, of any light weight, durable, and inexpensive material, such as wood or plastic, but is not limited to such examples or attributes.

The support block assembly 10 has a thickness z. The thickness of support block assembly 10 supports the durability of the invention and provides a suitable amount of rigidity to promote the ease of cutting through a material when the invention is pressed against a wall or surface. In a preferred embodiment, the thickness z may be ⅝ inch. However, the appropriate thickness will vary with the type of material used to make the support block assembly, and the thickness need not be constant throughout the support block assembly.

The support block assembly 10 has at least one primary surface, which defines a perimeter of the support block assembly. For example, FIG. 1 illustrates a primary surface 30. The perimeter of the support block assembly 10 is defined by the full length and width of this primary surface 30.

A preferred embodiment of the invention may also include one or more cutting blades 20 coupled to the support block assembly 10. The cutting blades may be any type of material suitable for cutting, such as metal or plastic, for example. FIG. 1 illustrates the one or more cutting blades extending away from the at least one primary surface 30. In a preferred embodiment of the invention, the cutting blades are arranged in a closed plane orientation. A closed plane includes, for example, where the figure or shape created by the orientation of the cutting blades is closed by line segments or curved lines. Examples of closed plane or closed figures are polygons (such as a triangle or rectangle), semi-circles, and circles. The cutting blades may be one continuous blade preformed into a particular orientation (not shown) or an arrangement of multiple blades (such as four blades in the shape of a rectangle as shown in FIG. 1). A person of ordinary skill would understand that multiple cutting blades arranged in a closed plane orientation does not necessarily require a zero tolerance (or no space) between where the blades would ideally intersect. Some degree of space between where the blades would ideally intersect may be expected as a practical matter and would not hinder the ability to cut a closed plane shape out of a wall or surface material. In accordance with the invention, the cutting blades may be smooth, serrated, saw-toothed, or any other linear or non-linear arrangement.

An exemplary typical shape to cut would be the size of a single gang electrical box with a length of 2.3 inches and a width of 4.2 inches. Another exemplary typical shape to cut would be the size of a dual gang electrical box with a length of 4.1 inches and a width of 4.2 inches. These are merely examples, and a person of ordinary skill would readily recognize that this invention is not so limited, and that the cutting blades may be arranged into many different shapes or dimensions.

The one or more cutting blades 20 are coupled to the support block assembly 10 in at least one location. For example, cutting blades may be coupled to the support block assembly 10 through a primary surface 30 using, for example, L-shaped cutting blades and any fixation means known to persons of ordinary skill, such as adhesive, nails, or screws (not shown). For another example, the cutting blades can also be coupled to the support block assembly 10 through a primary surface 60, again using any type of fixation means known to persons of ordinary skill (shown in FIG. 3 and FIG. 6). A person of ordinary skill would recognize that coupling could be direct or indirect.

The cutting blades may be permanently or removably coupled to the support block assembly. In a preferred embodiment, the cutting blades may be removably coupled to the support block assembly, such that they can be replaced with new blades, different blades, or no blades at all (for example, for storage or packaging). The arrangement of the cutting blades may also be adjustable, such that different closed plane shapes or figures may be achieved.

A preferred embodiment of the invention may also include the one or more cutting blades 20 extending away from the at least one primary surface 30 at an inset distance relative to the perimeter of the support block assembly 10. For example, FIG. 1 illustrates an exemplary inset distance x and another exemplary inset distance y. Inset distance x need not be equal to inset distance y, and either one of x or y may be zero. The inset distance functions to limit the depth of penetration of the one or more cutting blades 10 when using the blades to cut an opening in a material, such as a wall or surface.

For example, the invention may be used to cut an opening in a wall by placing the cutting blades to the wall and then pressing or striking the support block assembly, thereby causing the cutting blades to penetrate the wall or surface material. Without an inset distance, the entire support block assembly, including the one or more cutting blades coupled thereto, can penetrate through and then past the wall, and damage or destroy materials that lie on the other side of the wall. However, this is not the case with the inset distance according to the present invention. Because of the inset distance, some portion of the support block assembly will catch the part of the wall that has not been cut and prevent the one or more cutting blades from penetrating any deeper through or past the wall. Therefore, the inset distance limits the depth of penetration of the one or more cutting blades. The appropriate inset distance will vary depending on the material and thickness of the support block assembly. In a preferred embodiment, the inset distance may be ½ inch.

Figure 2:
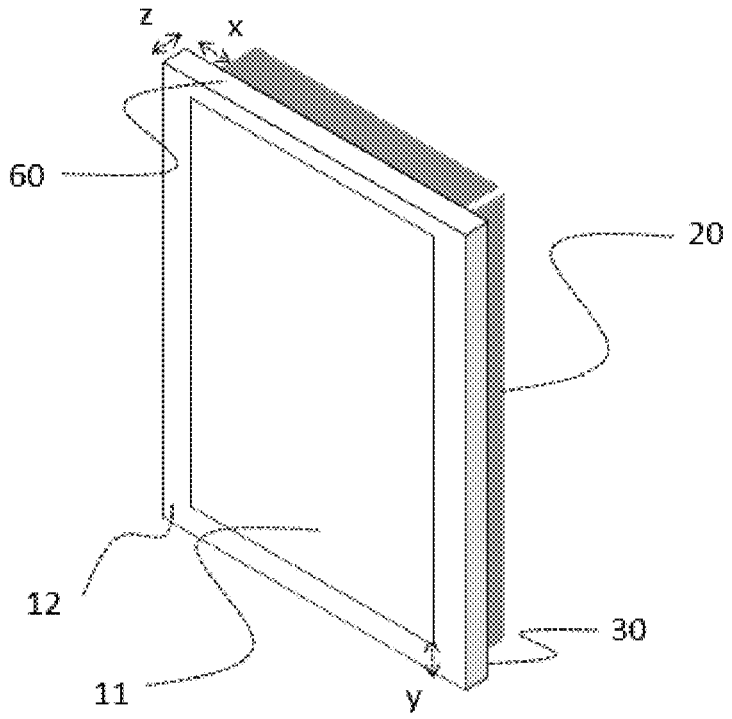
FIG. 2 shows an exemplary embodiment of the invention illustrating an apparatus that includes a support block assembly comprising multiple and separate components, and cutting blades arranged in a rectangular orientation and positioned at an inset distance relative to the perimeter of the support block assembly.

As illustrated in FIG. 2, in a preferred embodiment of the invention, the support block assembly 10 may be comprised of multiple and/or separate components. For example, the support block assembly 10 may be comprised of a first component 11 and a second component 12. The components together form a single integrated primary surface 30. Each of the components alone also forms a portion of the primary surface. For example, the primary surface 30 may include at least a first portion and a second portion, wherein the first portion is formed by first component 11 and the second portion is formed by second component 12.

The components together also form a single perimeter of the support block assembly 10, which is the same perimeter as in the embodiment where the support block assembly is comprised of only one component (FIG. 1). In a preferred embodiment where there are multiple and/or separate components, the first portion of the primary surface, formed by first component 11 in the exemplary FIG. 2, also has a perimeter. In such an embodiment, the one or more cutting blades 20 may be coupled to the support block assembly such that the blades extend away from the primary surface at the perimeter of the first portion. This arrangement forms an inset distance. In the exemplary FIG. 2, the inset distance x and inset distance y are defined by the dimensions of the second component 12 of the support block assembly.

The multiple and/or separate components of the support block assembly may be comprised of the same or different material. For example, the first component 11 in FIG. 2 may be comprised of plastic or wood, and the second component 12 may be comprised of rubber or foam. Alternatively, in another preferred embodiment, all components may be comprised of plastic. These are merely non-limiting examples, and the invention contemplates that the support block assembly may comprise any suitable material including plastics, woods, metals, foams, and/or any other material commonly used in construction.

The components of the support block assembly may be permanently or removably coupled to one another by any fixation means known to persons of ordinary skill, such as adhesive, nails, or screws. A person of ordinary skill would recognize that coupling could be direct or indirect.

Furthermore, first component 11 and second component 12 as illustrated in FIG. 2 are merely exemplary, and many other suitable shapes may be used and are contemplated by this invention. In addition, the thickness of the different components of the support block assembly need not be the same.

Figure 3:
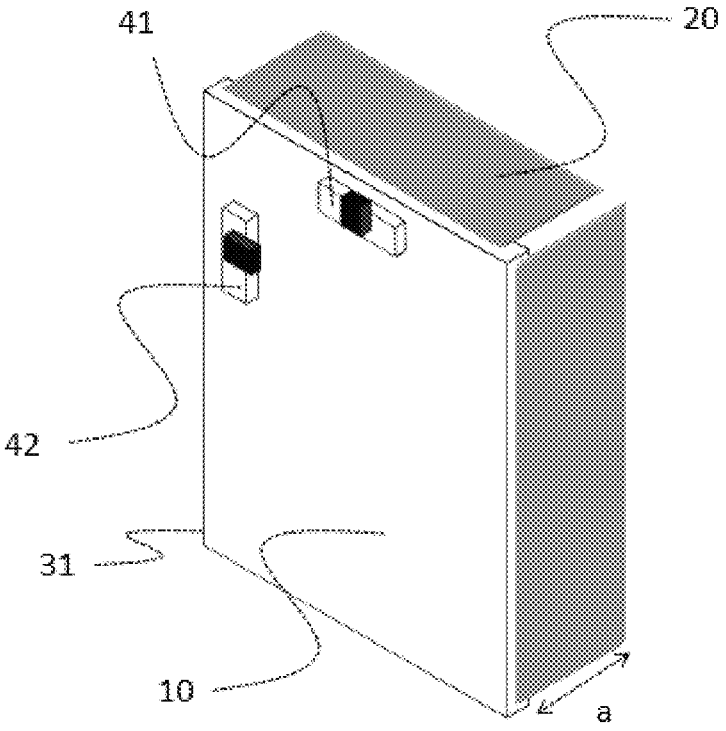
FIG. 3 shows an exemplary embodiment of the invention illustrating an apparatus that includes a support block assembly, multiple levels coupled to the support block assembly, and cutting blades arranged in a rectangular orientation.

As illustrated in FIG. 3, in a preferred embodiment of the invention, the support block assembly 10 may comprise a first primary surface and a second primary surface. For example, the first primary surface may be primary surface 60 (FIGS. 1-2), and the second primary surface may be primary surface 31 (as shown in FIG. 3). Alternatively, the first primary surface may be primary surface 30, or any other surface of the support block assembly. In accordance with the preferred embodiment illustrated in FIG. 3, the one or more cutting blades 20 may be coupled to the first primary surface 60, and one or more levels may be coupled to the second primary surface 31. For example, a level may be a horizontal level 41, or a level may be a vertical level 42. For another example, more than one level may be used at the same time. Two levels may be used, for instance, and oriented perpendicular to one another in order to provide two dimensional leveling. The one or more levels may be permanently or removably coupled to the second primary surface by any fixation means known to persons of ordinary skill, such as adhesive, nails, or screws. A person of ordinary skill would recognize that coupling could be direct or indirect. The levels provide precision when placing the cutting blades against a material, such as a wall or surface, without needing an additional tool to perform the leveling function. The one or more levels may be circular liquid type, vial liquid type, laser type, or any other level type known to a person of ordinary skill.

The size of the cutting blades may be adjusted to vary the exposed cutting length a, which also controls the depth of cutting. The exposed cutting length should preferably be at or around the thickness of the material being cut. As one non-limiting example, the exposed cutting length a may be preferably ¼ inch to ⅝ inch. One manner of adjusting the size of the cutting blades is to remove the cutting blades from the support assembly block and then replace them with cutting blades of a different size. Alternatively, in a preferred embodiment, the exposed cutting length a may be adjusted by coupling the cutting blade to a lower spot along the thickness of the support block assembly, thereby exposing a different length of the blade that is available for cutting.

Figure 4:
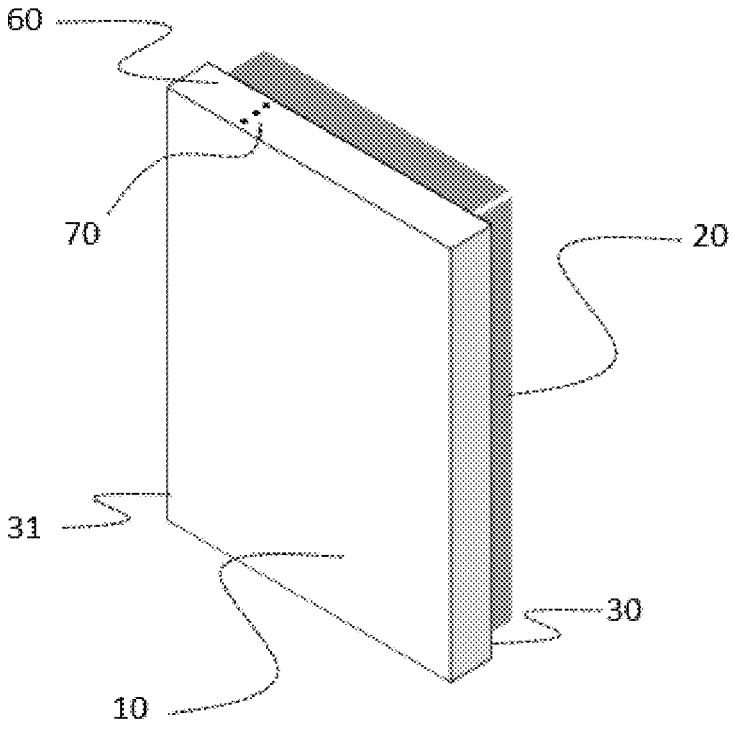
FIG. 4 shows an exemplary embodiment of the invention illustrating an apparatus that includes multiple locations for coupling cutting blades to the support block assembly.

As illustrated in FIG. 4, in a preferred embodiment of the invention, there may be two or more locations 70 along the thickness of the support block assembly 10 where the one or more cutting blades 20 may be coupled, which allows for adjusting the exposed cutting length a in order to control the depth of cutting.

The present invention also contemplates other ways to adjust the exposed cutting length a of the one or more cutting blades, such as retractable blades, varying the length of the non-exposed portion of the cutting blade, or varying the thickness of the support block assembly or components of the support block assembly.

Figure 5:
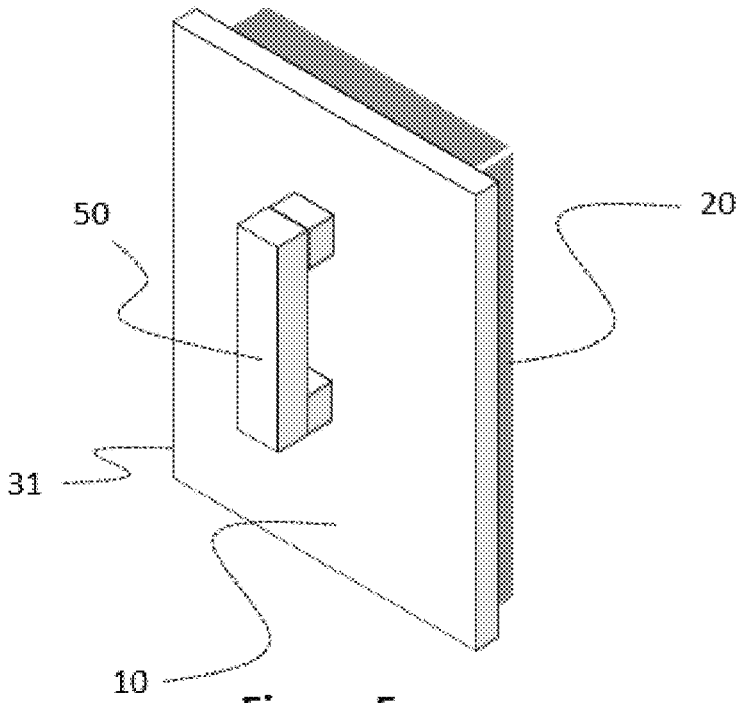
FIG. 5 shows an exemplary embodiment of the invention illustrating an apparatus that includes one type of handle.

As illustrated in FIG. 5, in a preferred embodiment of the invention, the support block assembly 10 may comprise a first primary surface and a second primary surface 31, wherein the second primary surface 31 comprises a handle 50 coupled thereto. The handle 50 provides better grip and cushion, and may further include finger safety lips, knuckle protection lips, or covers to protect the user from injury. Preferably, the handle 50 would be durable, comfortable, and fit any size hand. The handle 50 may be permanently or removably coupled to the second primary surface by any fixation means known to persons of ordinary skill, such as adhesive, nails, or screws. A person of ordinary skill would recognize that coupling could be direct or indirect.

Figure 6:
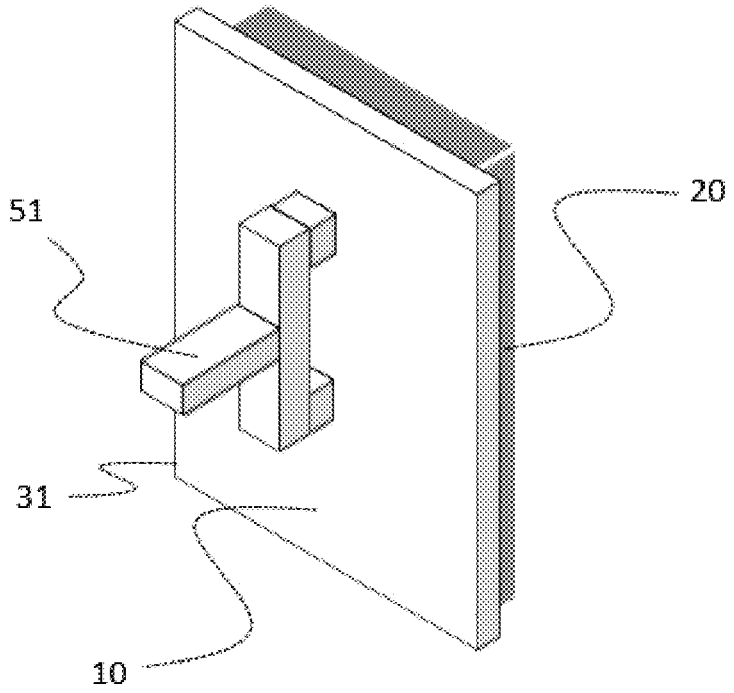
FIG. 6 shows an exemplary embodiment of the invention illustrating an apparatus that includes an alternative type of handle.

Another type of handle is illustrated in FIG. 6. In a preferred embodiment of the invention, the handle 51 may include a protruding striking member with a flat portion either as a part of the handle itself or as a permanent or removable attachment. This type of handle 51 provides an additional location to safely press or strike the apparatus, for example with a hammer, in order to drive penetration of the cutting blades into a material.

Figure 7:
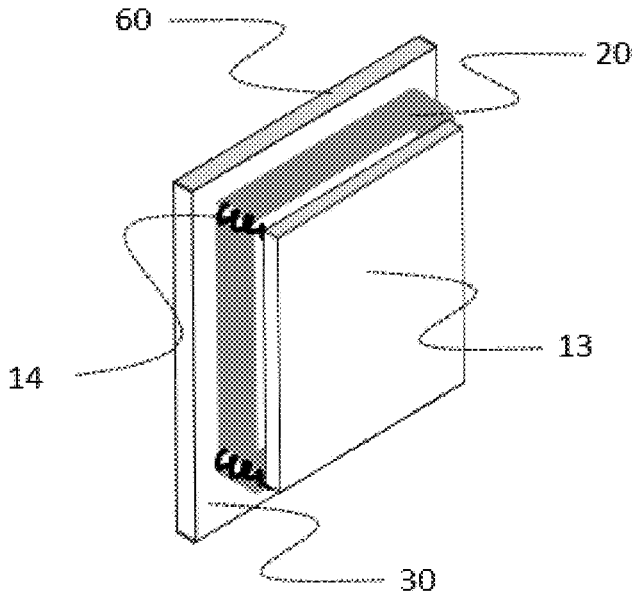
FIG. 7 shows another exemplary embodiment of the invention illustrating an apparatus that includes a support block assembly comprising multiple and separate components.
Figure 8:
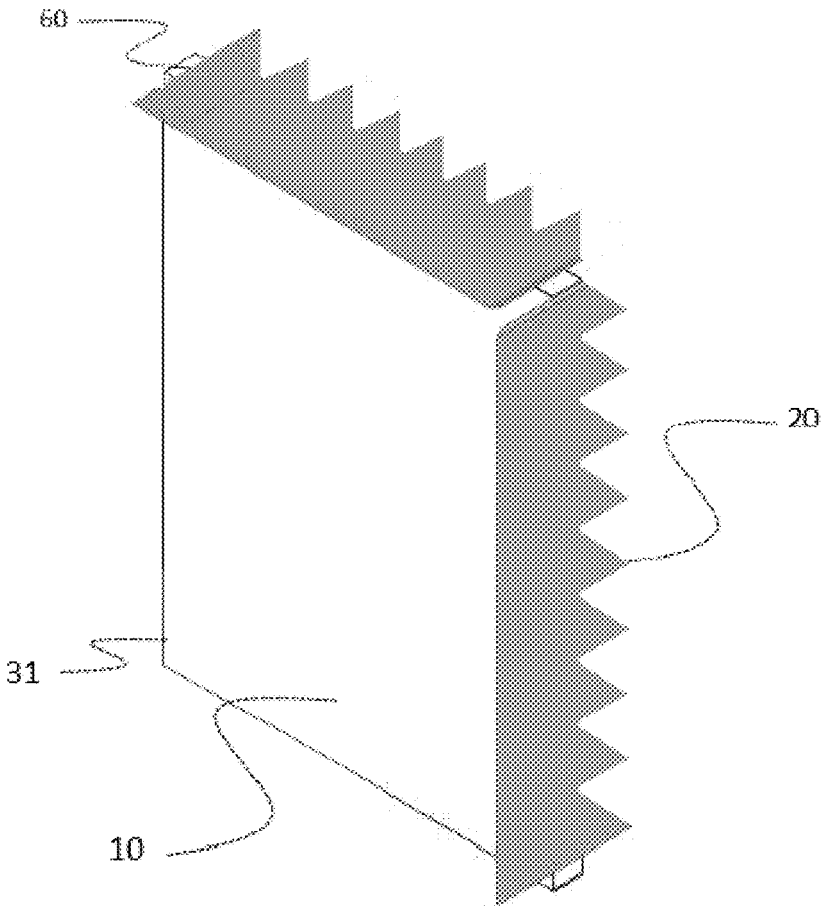
FIG. 8 shows another exemplary embodiment of the invention illustrating an apparatus that includes one or more cutting blades with a serrated edge.
Figure 9:
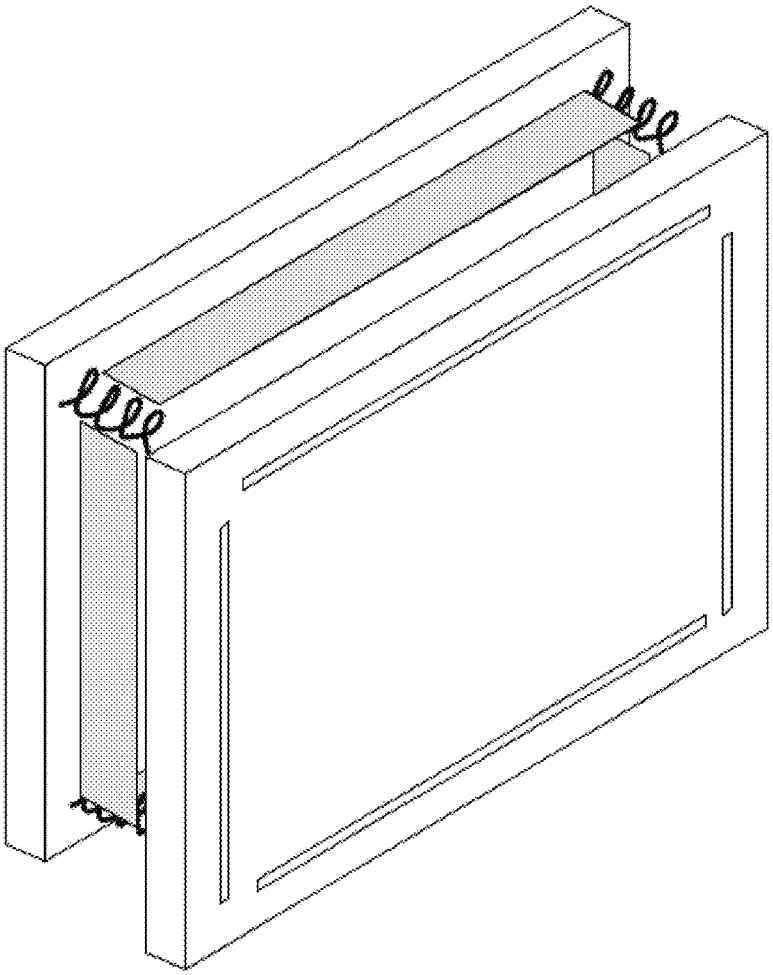
FIG. 9 shows another exemplary embodiment of the invention illustrating an apparatus that includes a support block assembly comprising multiple and separate components.

As illustrated in FIG. 7, in a preferred embodiment of the invention, the support block assembly 10 may further comprise a block 13 and one or more retractable mechanisms 14. Block 13 may be coupled to one or more retractable mechanisms 14, which in turn may be coupled to the primary surface 30 of the support block assembly 10. Retractable mechanism 14 may be a coil, spring, or any other mechanism known to those of skill in the art that can compress and re-extend. In such an embodiment, the block 13 may be of a size smaller than the area between the one or more cutting blades 20, such that when the invention is pressed against a wall or surface the retractable mechanism 14 allows the block 13 to recess into the area between the one or more cutting blades 20. The section of the wall or surface that is cut by the invention also recesses into the area between the one or more cutting blades, such that when the invention is removed from the wall or surface, the section that was cut from the wall or surface can be easily removed from the invention by the re-extending of the retractable mechanism 14.

Alternatively, the block 13 may be of a size larger than the area between the one or more cutting blades 20, and include slots or openings through which the blades can protrude, such that when the invention is not pressed against a wall or surface, the block 13 functions as a protective cover around the one or more cutting blades 20. In this embodiment, the cutting blades would only be exposed when the invention is pressed against a wall or surface to make a cut or opening, which increases the safety of using the invention. Thus, it is preferable that the thickness of block 13 be less than the exposed cutting length of the one or more cutting blades 20. And it is preferable that the retractable mechanism 14 be arranged such that the block 13 rests at a distance away from primary surface 30 approximately equal to the exposed cutting length of the one or more cutting blades 20, when the invention is not in use.

Block 13 and retractable mechanism 14 may be comprised of the same or different material as the rest of the support block assembly 10. For example, block 13 may be comprised of plastic or wood, and the retractable mechanism 14 may be comprised of rubber, plastic, or metal. Alternatively, in another preferred embodiment, all components may be comprised of plastic. These are merely non-limiting examples, and the invention contemplates that the support block assembly may comprise any suitable material including plastics, woods, metals, foams, and/or any other material commonly used in construction.

The components of the support block assembly may be permanently or removably coupled to one another by any fixation means known to persons of ordinary skill, such as adhesive, nails, or screws. A person of ordinary skill would recognize that coupling could be direct or indirect.

Furthermore, block 13 and retractable mechanism 14 as illustrated in FIG. 7 are merely exemplary, and many other suitable shapes may be used and are contemplated by this invention. In addition, the thickness of the different components of the support block assembly need not be the same.

Another preferred embodiment of the present invention is a method comprising the steps: (a) providing an apparatus comprising: a support block assembly having a thickness and at least one primary surface, the at least one primary surface defining a perimeter of the support block assembly; and one or more cutting blades coupled to the support block assembly in at least one location and extending away from the at least one primary surface, the one or more cutting blades being arranged in a closed plane orientation and each being coupled to the support block assembly such that the one or more cutting blades extend away from the at least one primary surface at an inset distance relative to the perimeter of the support block assembly; (b) pressing the provided apparatus against a material; and (c) cutting an opening in the material using the one or more cutting blades of the provided apparatus, wherein the inset distance operates to limit the depth of penetration through the material.

Using this method of the present invention, a user can quickly and easily achieve a perfect cutout every time with no risk of damage or destruction to the materials behind the wall.

Many modifications and other embodiments of the invention set forth herein will come to mind to one skilled in the art to which this invention pertains having the benefit of the teachings presented in the foregoing descriptions and the associated figures. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus comprising:

a support block assembly having a thickness and at least one primary surface, the at least one primary surface defining a perimeter of the support block assembly, the support block assembly comprising:

a first portion defining the at least one primary surface;

a second portion defining at least one secondary surface, the at least one secondary surface being oriented so as to face the at least one primary surface of the first portion;

one or more retractable mechanisms; and one or more cutting blades coupled to the support block assembly in at least one location and extending away from the at least one primary surface, the one or more cutting blades being arranged in a closed plane orientation defining an area within the closed plane orientation, and each of the one or more cutting blades being coupled to the support block assembly such that the one or more cutting blades extend away from the at least one primary surface at an inset distance relative to the perimeter of the support block assembly;

wherein the second portion of the support block assembly is directly coupled exclusively and only to the one or more retractable mechanisms such that the second portion is configured to move relative to and independent of the one or more cutting blades; the second portion of the support block assembly defines an area larger than the area of the closed plane orientation of the one or more cutting blades and comprises a plurality of slots arranged in an orientation identical to that of the one or more cutting blades, such that the second portion of the block assembly can extend and retract relative to the cutting blades without physically engaging the blades; and wherein the retractable mechanisms are springs.

2. The apparatus of claim 1, wherein the first portion and second portion are comprised of the same material.

3. The apparatus of claim 1, wherein the first portion and second portion are not comprised of the same material.

4. The apparatus of claim 1, wherein the inset distance is at least ½ inch.

5. The apparatus of claim 1, wherein the thickness of the support block assembly is at least ⅝ inch.

6. The apparatus of claim 1, wherein:

the first portion of the support block assembly comprises a first primary surface and a second primary surface;

the one or more cutting blades coupled to the first primary surface; and one or more levels are coupled to the second primary surface.

7. The apparatus of claim 6, wherein:

the one or more levels comprise a first level and a second level; and the first level is oriented in a first direction and the second level is oriented in a second direction, the second direction being perpendicular to the first direction.

8. The apparatus of claim 1, wherein at least one cutting blade is serrated.

9. The apparatus of claim 1, wherein at least one cutting blade has an exposed cutting length of ¼ inch to ⅝ inch.

10. The apparatus of claim 1, wherein:

the at least one location at which the one or more cutting blades are coupled to the support block assembly comprises two or more locations; and each of the two or more locations are configured to couple the one or more cutting blades to the support block assembly in a manner such that an exposed cutting length is different in each of the two or more locations.

11. The apparatus of claim 1, wherein an exposed cutting length of at least one cutting blade is adjustable in order to control the depth of cutting.

12. The apparatus of claim 1, wherein the first portion comprises a handle coupled thereto.

13. The apparatus of claim 1, wherein the one or more retractable mechanisms each comprises a first end and a second end, the first end being coupled to the at least one primary surface of the first portion and the second end being coupled to the at least one secondary surface of the second portion.

14. The apparatus of claim 1, wherein the inset distance is 0.0 inches, such that the one or more cutting blades are positioned along the perimeter of the support block assembly.

15. The apparatus of claim 1, wherein the second portion of the support block assembly is capable of extending beyond the one or more cutting blades when the one or more retractable mechanisms are in a fully extended position.

16. A method comprising:

(a) providing an apparatus comprising:

a support block assembly having a thickness and at least one primary surface, the at least one primary surface defining a perimeter of the support block assembly, the support block assembly comprising:

a first portion defining the at least one primary surface;

a second portion defining at least one secondary surface, the at least one secondary surface being oriented so as to face the at least one primary surface of the first portion;

one or more retractable mechanisms; and one or more cutting blades coupled to the support block assembly in at least one location and extending away from the at least one primary surface, the one or more cutting blades being arranged in a closed plane orientation defining an area within the closed plane orientation, and each of the one or more cutting blades being coupled to the support block assembly such that the one or more cutting blades extend away from the at least one primary surface at an inset distance relative to the perimeter of the support block assembly;

wherein the second portion of the support block assembly is directly coupled exclusively and only to the one or more retractable mechanisms such that the second portion is configured to move relative to and independent of the one or more cutting blades; the second portion of the support block assembly defines an area larger than the area of the closed plane orientation of the one or more cutting blades and comprises a plurality of slots arranged in an orientation identical to that of the one or more cutting blades, such that the second portion of the block assembly can extend and retract relative to the cutting blades without physically engaging the blades; and wherein the retractable mechanisms are springs;

(b) pressing the provided apparatus against a material; and (c) cutting an opening in the material using the one or more cutting blades of the provided apparatus, wherein the inset distance operates to limit the depth of penetration into the material.

* * * * *